United States Patent [19]

Scarnera et al.

[11] Patent Number: 4,831,537

[45] Date of Patent: May 16, 1989

[54] SYSTEM FOR CORRECTION OF THE FUEL INJECTION TIME, UPON VARIATIONS IN ALTITUDE, FOR A HEAT ENGINE HAVING AN ELECTRONIC INJECTION SYSTEM

[75] Inventors: Michele Scarnera, Monzuno; Paolo Francia, Zola Predosa, both of Italy

[73] Assignee: Weber S.p.A., Turin, Italy

[21] Appl. No.: 907,308

[22] Filed: Sep. 12, 1986

[30] Foreign Application Priority Data

Sep. 20, 1985 [IT] Italy ..... 67800 A/85

[51] Int. Cl.[4] ..... F02P 5/15; F02D 25/00; F02D 41/26

[52] U.S. Cl. ..... 364/431.05; 123/488; 123/480; 123/478

[58] Field of Search ..... 364/431.05, 558; 123/478, 427, 480, 357, 488, 412

[56] References Cited

U.S. PATENT DOCUMENTS

| | | | |
|---|---|---|---|
| 4,492,202 | 1/1985 | Muramatsu et al. | 123/478 |
| 4,590,563 | 5/1986 | Matsumura et al. | 364/431.05 |
| 4,696,275 | 9/1987 | Kushi et al. | 364/431.05 |
| 4,697,568 | 10/1987 | Yasuoka | 123/478 |

*Primary Examiner*—Felix D. Gruber
*Assistant Examiner*—V. N. Trans
*Attorney, Agent, or Firm*—Gifford, Groh, Sheridan, Sprinkle and Dolgorukov

[57] ABSTRACT

A system for correction of the fuel injection time control upon variation in altitude, for a heat engine having an electronic fuel injection system, and having means for substantially detecting the value of the external atmospheric pressure and the consequently correcting the value of induction air pressure utilized by a central processing unit of the injection system for calculating the injection time.

3 Claims, 1 Drawing Sheet

SYSTEM FOR CORRECTION OF THE FUEL INJECTION TIME, UPON VARIATIONS IN ALTITUDE, FOR A HEAT ENGINE HAVING AN ELECTRONIC INJECTION SYSTEM

BACKGROUND OF THE INVENTION

The present invention relates to a system for correction of the fuel injection time control upon variation in altitude, for a heat engine having an electronic fuel injection system, in particular a sequential and phased system.

As is known, electronic fuel injection systems for heat engines have an electronic central control unit which, in dependence on signals which it receives from various sensors (principally sensors detecting the speed of rotation and phase of the engine, and sensors detecting the pressure and temperature of the induction air) determines for example the density of the air in the manifold and the speed of rotation of the engine so that, in dependence on the volumetric capacity of the engine itself and the desired mixture strength, calculates from an interpolation on respective memorized mappings, the phase and the injection time of the fuel at the injectors, as well as the ignition advance.

The setting up and calibration of the injection system takes place at an external atmospheric pressure which is about 760 mm Hg, corresponding to a variable altitude generally up to 300 meters above sea level. During the various travels of the vehicle, at different altitudes, it can happen that as the external atmospheric pressure gradually falls (there is a reduction of about 80 mm Hg for each 1000 meters of height variation) there is an alteration of the operating characteristics of the engine, in particular of the volumetric capacity, in dependence on the different pressure losses in induction and exhaust. The phenomenon involves a variation in the mixture strength towards lean conditions which displace the slow running of the engine to lower values which are often not acceptable.

SUMMARY OF THE INVENTION

The object of the present invention is therefore that of providing a system for self-correction, upon altitude variations, of the fuel injection control time so as to compensate the variations in the fuel mixture strength during journeys of the vehicle with height variations, and to maintain the operating conditions of the engine substantially independently of variations in external atmospheric pressure.

According to the present invention there is provided a system for self-correction, upon variation in altitude, of the fuel injection time control for a heat engine having an electronic fuel injection system, characterized by the fact that it comprises means for substantially detecting the value of the external atmospheric pressure and for correcting, consequent thereon, the induction air pressure value utilised by a central processing unit of the said injection system for calculating the said injection time.

BRIEF DESCRIPTION OF THE DRAWINGS

For a better understanding of the present invention a particular embodiment will now be described, purely by way of non-limitative example, with reference to the attached drawings, in which.

DETAILED DESCRIPTION OF THE INVENTION

Figure 1:
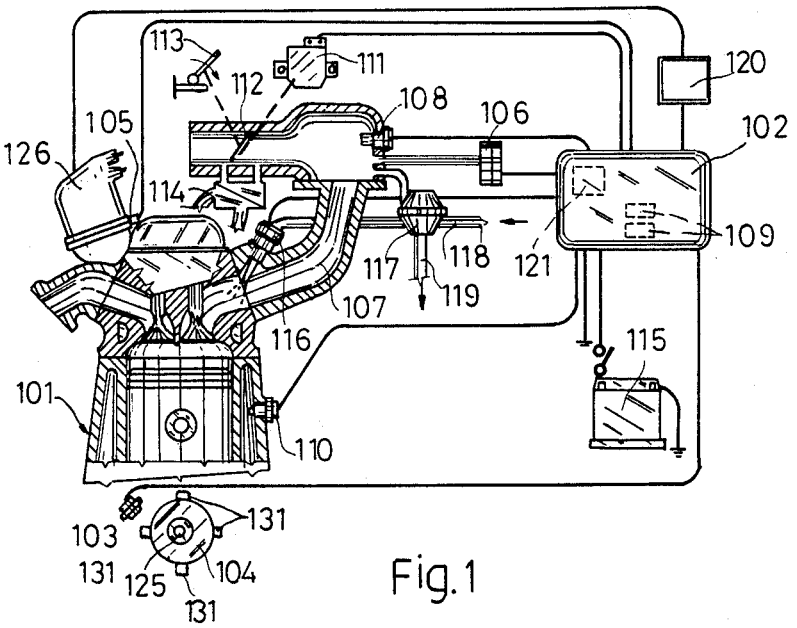
FIG. 1 is a schematic view of an electronic injection system for a heat engine with the self-correction system of the present invention.

With reference to FIG. 1, there is schematically shown an electronic injection system for a heat engine 101, conveniently having four cylinders, represented partially and in section.

This system includes an electronic central processing unit 102 comprising, in a substantially known way, a microprocessor 121 and registers in which are memorized mappings relating to different operating conditions of the engine 101. This central control unit 102 further includes, among other things, memory registers 109. This central control unit 102 receives signals from:

a sensor 103 for detecting the speed of rotation of the engine 101, disposed opposite a pulley 104 keyed to a crankshaft 125 and carrying four teeth 131 equally spaced by 90°, a sensor 105 for detecting the phase of the engine 101, positioned in a distributor 126, a sensor 106 for detecting the absolute pressure existing in an induction manifold 107 of the engine 101, a sensor 108 for detecting the air temperature in the manifold 107, a sensor 110 for detecting the water temperature in the cooling jacket of the engine 101, a sensor 111 substantially constituted by a potentiometer, and a detector for detecting the angular position of a butterfly valve 112 disposed in the induction manifold 107 and controlled by the accelerator pedal 113: in parallel with this butterfly valve 112 there is disposed a valve 114 for the introduction of supplementary air.

This electronic central control unit 102 is then connected to an electrical supply battery 115 and to earth, and, in dependence on the signals from the said sensors, the operating conditions of the engine and the density of the air are utilized to determine the required quantity of fuel to be injected in dependence on the desired mixture strength. This central control unit 102 therefore controls the length of time for which the injectors 116 disposed in the manifold 107 in proximity to the induction valve of each respective cylinder are open, to control the quantity of fuel provided to the different cylinders of the engine 101 and to control the phasing of the injection by controlling the commencement of delivery of fuel with respect to the phases (induction, compression, expansion, exhaust) of the engine 101. Each injector 116 is fed with fuel through a pressure regulator 117 sensitive to the pressure in the induction manifold 107 and having a fuel inlet duct 118 for fuel coming from a pump (not illustrated) and a return duct 119 for returning fuel to the reservoir (not illustrated). The electronic central control unit 102 is further connected to an ignition pulse control unit 120 for controlling ignition pulses which are provided to the distributor 126.

The operation of the system for self-correction of the injection time upon variation in the altitude, formed according to the present invention, will now be described with reference to FIG. 2, with the brief preliminary consideration that the same sensor 106 which detects the pressure of the air in the induction manifold 107 is used as the external atmospheric pressure sensor in particular operating conditions of the engine, namely with the engine stopped and with the engine under full load with the butterfly valve 112 open beyond a predetermined angular value; in such operating conditions, in which the pressure detected in substantially atmospheric pressure, calculation of a correction factor in dependence on the displacement of the external atmospheric pressure from the pressure value at sea level (the initial calibration pressure), and of a coefficient dependent on the compression ratio of the engine is enabled. This correction factor is then added to the induction air pressure value, detected by the sensor 106, to determine the necessary enrichment of the fuel mixture provided to the engine 101 so as to maintain the mixture strength substantially unvaried upon changes in altitude.

Figure 2:
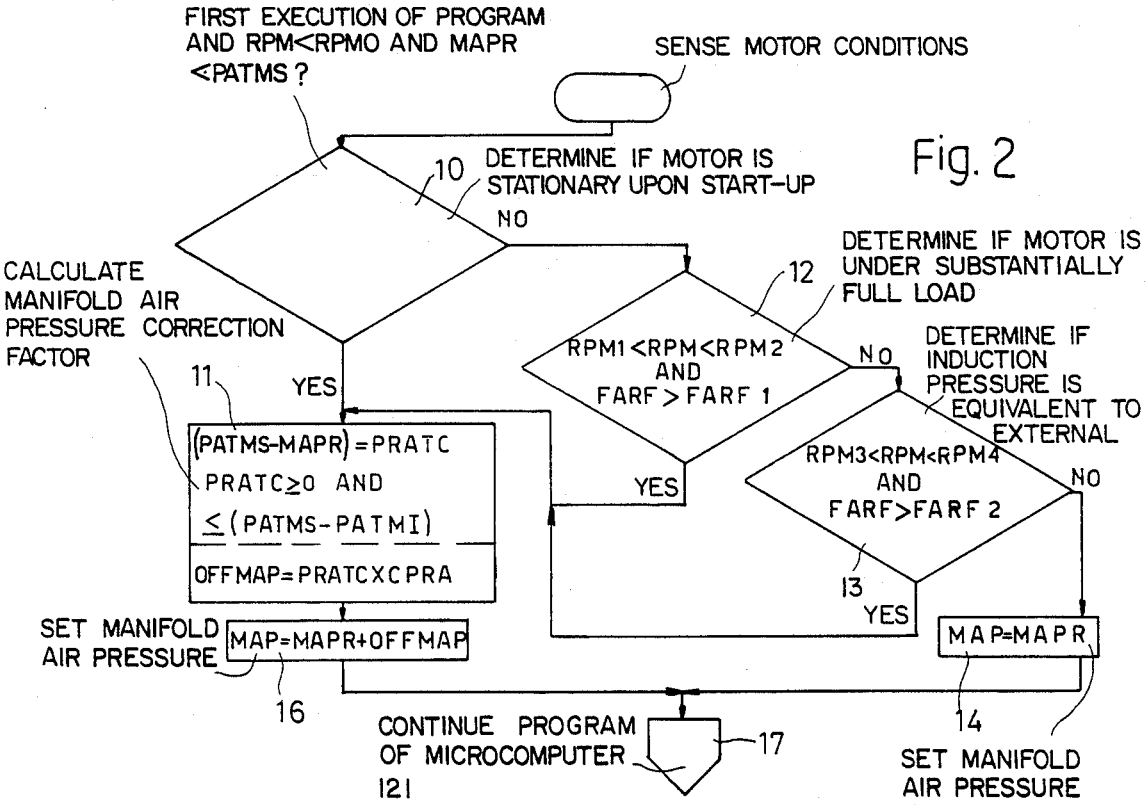
FIG. 2 is an operating block diagram of the self correcting system of the present invention.

With reference to FIG. 2, in the program of the electronic injection system, controlled by the microprocessor 121, at each cycle, there is a stage 10 which detects the initial condition of the stationary motor upon starting up, so as to detect if it is the first execution of the program and if the speed of rotation (RPM) of the motor 101 is less than a predetermined minimum value (RPMO, equal, for example, to 457 revolutions per minute), and moreover to detect if the value of the air pressure detected by the sensor 106, and indicated MAPR is correct and, that is to say, less than the possible upper limit of the atmospheric pressure indicated PATMS, equal to 760 mm Hg. Upon verification of these conditions, which guarantee that the value of the pressure in the induction manifold 107, detected by the sensor 106, is substantially the same as the external atmospheric pressure, the program passes to a calculation stage 11 for calculating a correction factor OFFMAP, which will be specified better hereinbelow. If the conditions tested at the stage 10 result in a negative answer the program passes instead to a stage 12 which tests if the motor 101 is in a dynamic operating condition, substantially at full load, such that the air pressure value in the induction manifold 107 is substantially equal to the value of the external atmospheric pressure, that is to say, if the speed of rotation RPM lies between two limit values RPM 1 and RPM 2, fixed, for example, at 100 and 1500 revolutions per minute, and moreover, if the position of opening of the butterfly valve 112 indicated FARF, is greater than a threshold angular value indicated FARF1 and corresponding, for example, to an opening of 60°. In the positive case it then passes to the stage 11 for the calculation of the correction factor OFFMAP, while in the negative case it leads to a stage 13 which checks if the motor 101 is in another dynamic operating condition such that the air pressure value in the induction manifold 107 can still be considered substantially equal to the value of the external atmospheric pressure: this stage 13 therefore detects if the speed of rotation of the engine 101, indicated RPM, lies between two limit values RPM 3 and RPM 4, fixed, for example, at 3500 and 3700 revolutions per minute, and if the angular position FARF of the butterfly valve 112 is greater than a value FARF2 corresponding, for example, to an opening of 50°; in the positive case this leads to the calculation stage 11, while in the negative case, that is in the situation that the sensor 106 does not detect a pressure value corresponding to the external atmospheric pressure value, this leads to a stage 14 which puts the calculated value MPA of the induction air pressure equal to the value MAPR detected by the sensor 106.

The stage 11 first of all calculates the difference (PRATC) between the greater atmospheric pressure (PATMS) and the value (MAPR) detected by the sensor 106, which is indicative of the variation of the external pressure upon variation of altitude, then tests if this difference PRATC is greater than or equal to zero, and in the contrary case fixes it at zero, and if it is less than or equal to the difference between the admissible limit value of the atmospheric pressure between sea level and the highest attainable level, indicated PATMS and PATMI, and equal, for example, to 760 mm Hg and 510 mm Hg respectively. Then the correction factor OFFMAP is calculated as a product of this difference PRTAC and a coefficient CPRA dependent on the compression ratio of the engine. From the stage 11 the program goes to a stage 16 which calculates the pressure value MAP utilized by the central control unit 121 as a sum of the pressure value MAPR detected by the sensor 106 and the correction factor OFFMAP. From the stages 14 or 16 the program then passes to a stage 17 which controls the subsequent operation of the program through the microcomputer 121 for the subsequent calculations and the actuation of the sequential and phased control of the supply to the fuel injectors 116.

With the described self-correction system of the present invention there is therefore an automatic adaptation of the control time of the duration of opening of the injectors in dependence on the external atmospheric pressure, upon each starting of the engine 101, by means of the stage 10, and automatically during the operation of the vehicle between different altitudes there are subsequent updating corrections by means of the stages 12 or 13 which detect the operating conditions of the engine 101 at which the pressure in the induction manifold 107 is substantially the same as the external pressure. In all these conditions the stage 11 is thereby enabled to calculate the correction factor which is added, in the stage 16, to the signal provided by the pressure sensor 106 to provide a new calculated value of the induction air pressure such as to cause an enrichment of the mixture sent to the engine for the purpose of maintaining the mixture strength substantially constant.

The advantages obtained with the self-correction system of the present system are evident from what has been described; among other things the same elements (pressure sensor 106 and central control unit 121) are utilized as are already present in the injection system itself.

Finally, it is clear that the described embodiments and the illustrated characteristics of the self-correction system of the present invention can have modifications and variations introduced thereto which do not depart from the scope of the invention itself.

We claim:

1. A system for altitude-dependent automatic correction of the fuel injection time of an electronic fuel injection (EFI) system of a heat engine, comprising:

an accelerator;

an air supply valve to said engine controlled by said accelerator to open to a variable angular value;

a pressure sensor for detecting induction air pressure (IAP) value of said engine;

a speed sensor for detecting engine speed;

a central processing unit (CPU) in said EFI system utilizing a corrected IAP value for calcuation of said fuel injection time; and means for correcting said IAP value; comprising:

means for detecting operating conditions of said engine when said IAP value is substantially equal to the external atmospheric pressure and for consequently enabling second means for calculating a correction factor for determination of said correct IAP value, said means including:

(a) means detecting the operating condition of said engine upon start-up and enabling said second means when the speed of the engine is less than a first predetermined value and the measured IAP value is less than a predetermined upper limit;

(b) means detecting the operating condition of said engine under a first, full load, dynamic running condition and enabling said second means when not enabled at start-up (a) when the speed of the engine lies within a first predetermined range and said air supply valve is open to at least a first predetermined angular value;

(c) means detecting the operating conditions of said engine under a second dynamic running condition and enabling said second means when not enabled at start-up (a) or full load (b) when the speed of the engine lies within a second predetermined range and said air supply valve is opened to at least a second predetermined angular value;

wherein said second means utilizes an IAP value detected by said pressure sensor in calculating said correction factor.

2. The invention according to claim 1, wherein said second means comprises means for determining said correction factor in dependence upon the displacement of said external air pressure value substantially from sea level pressure, and in dependence upon the compression ratio of said engine, said second means adding said correction factor to said IAP value to determine the necessary enrichment of the fuel mixture of said engine.

3. The invention according to claim 1, wherein said detecting said correcting means are incorporated in said engine CPU.

* * * * *